United States Patent [19]

Lechnick et al.

[11] Patent Number: 4,906,355

[45] Date of Patent: Mar. 6, 1990

[54] TAR SANDS EXTRACT FINES REMOVAL PROCESS

[75] Inventors: William J. Lechnick, Bensalem, Pa.; Richard A. Stone, Yorkville, Ill.

[73] Assignee: Amoco Corporation, Chicago, Ill.

[21] Appl. No.: 324,022

[22] Filed: Mar. 16, 1989

[51] Int. Cl.[4] ..... C10G 1/04

[52] U.S. Cl. ..... 208/390; 208/391

[58] Field of Search ..... 208/390, 391

[56] References Cited

U.S. PATENT DOCUMENTS 4,094,781 6/1978 Snell et al. ..... 208/391

4,584,087 4/1986 Peck ..... 208/390

4,596,651 6/1986 Wolff et al. ..... 208/390

FOREIGN PATENT DOCUMENTS 606742 10/1960 Canada ..... 208/390

*Primary Examiner*—Asok Pal

*Attorney, Agent, or Firm*—Nick C. Kottis; William H. Magidson; Ralph C. Medhurst

[57] ABSTRACT

A process for removing fines from a tar sands extract is provided. The tar sands extract is contacted with a specific solvent to form agglomerates and a substantial portion of the agglomerates are separated from the balance of the extract prior to any substantial attrition of the agglomerates.

16 Claims, 1 Drawing Sheet

TAR SANDS EXTRACT FINES REMOVAL PROCESS

BACKGROUND OF THE INVENTION

This invention relates generally to tar sands extraction and, more particularly, to a process for the removal of mineral fines from tar sands extracts.

In view of the recent instability of the price of, and consumer country access to, crude oil, researchers have renewed their efforts to find alternate sources of energy and hydrocarbons. One of the possible sources for at least a portion of our energy needs is tar sands, also commonly referred to as oil sands or bitumen sands. Tar sands are generally characterized as comprising a consolidated or partially consolidated porous mineral structure, e.g., sandstone, which contains a high proportion of bitumen, i.e., a three component system of oils, resins and asphaltenes, with each of these components typically having successively higher solubility parameters. Thus, the bitumen consists of a mixture of a variety of hydrocarbons and, if properly separated from the sand or mineral component, can be used as a feedstock for the production of synthetic fuels and/or petrochemicals. For example, the tar sand deposits of the intermountain region of the western United States have an estimated reserve of more than twenty-eight billion barrels of oil in place. Although this resource is only a small fraction of the total United States oil requirement, it could be an important source of hydrocarbons on a regional basis.

The nature of tar sands varies greatly depending upon their geographical source insofar as certain tar sands deposits are more easily processed than others. For example, Athabasca tar sands from Alberta, Canada, have an average bitumen content of about 12–13 weight percent and a relatively high moisture content of about 3–5 weight percent. It is believed that these tar sands consist of aggregates of sand, wherein each grain of sand is surrounded by a film of connate water, which separates the bitumen from the sand grains. This structure permits a relatively easy separation of the bitumen from the mineral component of the tar sands, even when such tar sands are processed on a large scale. In fact, commercial hot water extraction processes for recovering bitumen from Athabasca tar sands presently exist. A good review of the Alberta tar sands projects is presented in an article entitled "Tar Sands: A New Fuels Industry Takes Shape," Science, Vol. 199, page 756 (February 1978).

On the other hand, most deposits of tar sands found in the intermountain region of the U.S. have an average of less than about 10 weight percent bitumen and negligible amounts of connate water, hence the bitumen is in direct contact with the grains of sand. This situation makes recovery much more difficult. Examples of such tar sands include the Sunnyside and Asphalt Ridge deposits found in Utah.

A further type of tar sand found mostly in California is the diatomaceous earth type, which contains up to about 25 weight percent bitumen. In this type of deposit the bitumen is contained within the very fine pores of the matrix and consequently is generally relatively difficult to extract. Such deposits typically also yield a large amount of mineral fines upon extraction.

In addition to a variety of aqueous extraction processes, other extraction processes have been disclosed which, among other features, use one or more of a variety of solvents. For example, U.S. Pat. No. 3,941,679 discloses the use of trichloromethane as an extraction solvent. U.S. Pat. No. 4,036,732 discloses the use of paraffinic hydrocarbons having from 5 to 9 carbon atoms. U.S. Pat. No. 4,046,663 teaches the use of a naphtha/methanol solvent system.

In selecting a solvent system for tar sands extraction, a number of factors are generally considered in evaluating performance. An obvious factor in evaluating the performance of a solvent system in tar sands extraction is the effectiveness of the solvent in separating the bitumen from the sands. This is often counterbalanced by a second consideration, however, which is the asphaltene content of the recovered bitumen. Asphaltenes are complex high molecular weight hydrocarbons which may be undesirable in particular subsequent refining processes. In this regard, an article entitled, "A Solubility of Asphaltenes in Hydrocarbon Solvent," by D. L. Mitchell and J. G. Speight, Fuel, Vol. 52, pp. 149–152 (1973), extensively explores the solubility of asphaltenes for over 50 different solvents and blends.

A third factor of importance is the fines or mineral particle content of the extracted bitumen. Mineral fines initially present in the tar sands as well as mineral fines formed, such as during grinding operations of a tar sands sample in preparation for extraction recovery of bitumen from the sample, pose difficult downstream processing, e.g., pumping, mixing, separation, etc., problems. The rate at which such fines settle is to a large extent dependent upon the solvents used and has been thought to be primarily determined by the density and viscosity of the solvent.

SUMMARY OF THE INVENTION

It is an object of the present invention to overcome one or more of the problems described above.

According to the invention, a method of removing fines from a tar sands extract which includes bitumen, non-specific solvent and fines involves contacting the tar sands extract with a specific solvent and intimately mixing the specific solvent with the extract to form agglomerates which include asphaltenes and a substantial portion of the fines contained in the extract. A substantial portion of these agglomerates are then separated from the balance of the extract prior to any substantial attrition of the agglomerates.

In one particular preferred embodiment, a tar sands extract including non-specific solvent, bitumen including asphaltenes and fines including inorgaic materials such as clays, carbonates, silicates and mixtures thereof, with the mineral fines having a size less than about 10 microns and being present in an amount less than about 5 weight percent to about 50 weight percent of the extract based on solvent-free bitumen, is mixed with a specific solvent via a static in-line mixer to form agglomerates of asphaltenes and a substantial portion of the mineral fines of the extract. A substantial portion of these agglomerates are then gravitatonally separated from the balance of the extract in a lamella separator to avoid substantial attrition of the agglomerates.

As used in this application, the term "non-specific solvent" is any solvent capable of dissolving all of the bitumen components, including the asphaltenes. Suitable non-specific solvents may include haloethanes, such as chloroethane; halomethanes, such as dibromodifluromethane; chlorofluorocarbons; chloroform; carbon tetrachloride; cyclic hydrocarbons such as benzene, toluene, and methyl cyclohexane; and aromatic petroleum fractons, which can generally be a very economical source of solvent, for example.

The term "specific solvent" as used herein refers to those solvents which generally do not dissolve all of the bitumen components, notably the asphaltenes, e.g., solvents having limited solubility for asphaltenes as compared to non-specific solvents, and suitably may include the $C_3$–$C_7$ alkanes and corresponding petroleum fractions.

The term "asphaltenes" is defined as toluene soluble solids which are insoluble in n-pentane at high dilutions.

The term "fines" as used herein refers to particulate mineral solids having a particle size of less than about 400 mesh (37 microns).

The term "substantial" as used herein in reference to the degree or extent of agglomerate attrition means more than about 10 percent of the agglomerates present or formed prior to separation of the agglomerates from the balance of the extract.

Other objects and advantages of the invention will be apparent to those skilled in the art in the following detailed description, taken in conjunction with the appended claims and drawings.

DETAILED DESCRIPTION OF THE INVENTION

According to the invention, fines are removed from a tar sands extract, including bitumen, non-specific solvent and mineral fines by a process wherein the tar sands extract is contacted and mixed with a specific solvent to form agglomerates which include asphaltenes from the bitumen and fines from the extract. These agglomerates are subsequently separated from the balance of the extract prior to any substantial attrition thereof.

Figure 1:
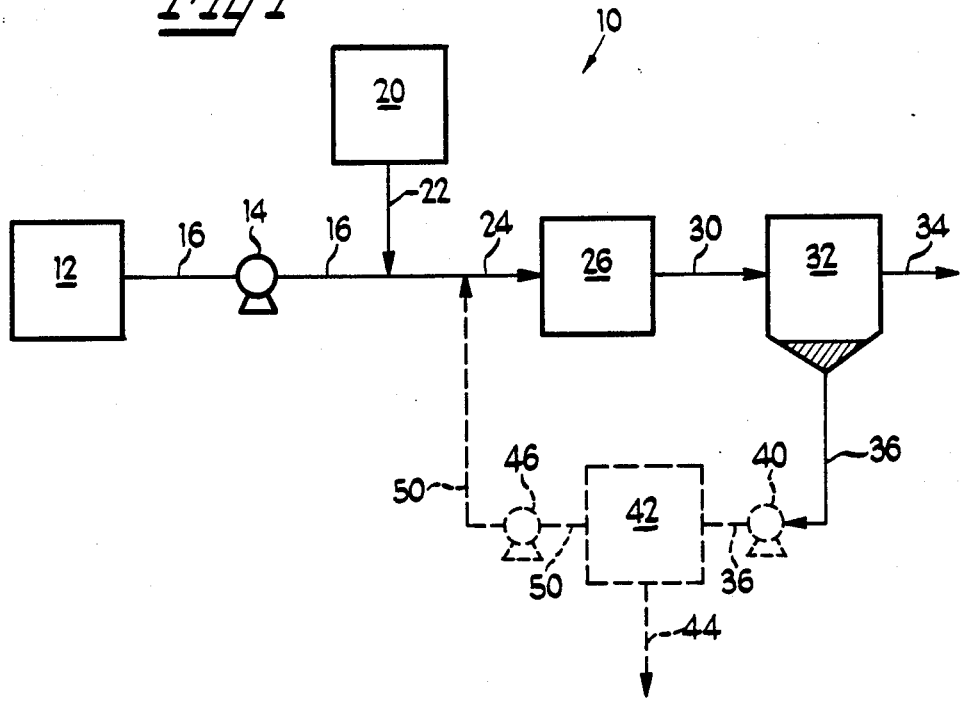
FIG. 1 is a simplified schematic flow diagram of a system for the removal of fines from a tar sands extract in accordance with principles of the invention.

Referring to FIG. 1, a system, generally designated 10, useful in the removal of mineral fines from a tar sands extract is shown. Such mineral fines typically include inorganic materials such as clays, carbonates, silicates or mixtures thereof and have a size of less than about 10 microns. Generally, such fines amount to about 5 weight percent to about 50 weight percent of the extract to be treated, on a solvent free bitumen basis.

The system 10 includes a tar sands extract reservoir 12 from which a tar sands extract including bitumen, non-specific solvent and fines, is transferred by means of a pump 14 through a line 16.

A specific solvent effective to agglomerate a selected quantity of the mineral fines contained in the extract, as described hereinbelow, is transferred from a storage tank 20 through a line 22 and combined with the line 16, whereby the tar sands extract is contacted with the specific solvent, to form a stream 24 which is passed through a static in-line mixer 26 or other mixing means effective in intimately mixing the specific solvent with the extract to agglomerate a selected quantity of fines contained in the extract, preferably a substantial portion of such fines as described below, with asphaltenes, a process commonly referred to as "deasphaltening."

A mixed stream 30 exits the mixer 26 and is passed to a separator 32 wherein agglomerates are separated from the balance of the solvent extract. A substantially fine-free stream 34 exits from the separator 32 and may, if desired, be subsequently treated. For example, if desired, the relatively fine-free bitumen containing stream 34 may be passed through an evaporator (not shown) or like means whereby non-specific solvent and/or specific solvent are evaporated, leaving a substantially fine-free solid, bitumen.

In a particularly preferred embodiment of the invention, the separator 32 comprises a lamela separator, also commonly referred to as lamella thickener or settler.

Figure 2:
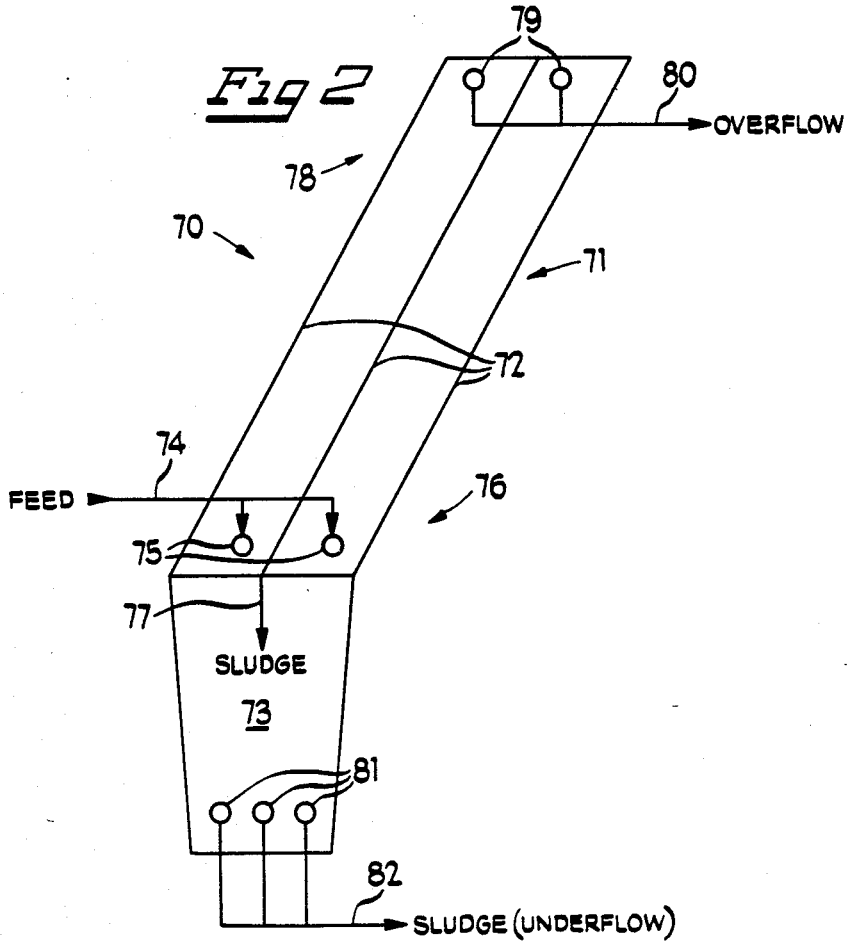
FIG. 2 is a simplified schematic diagram of a lamella separator according to one embodiment of the invention.

FIG. 2 shows a simplified schematic diagram of a lamella separator, generally designated 70, useful in the practice of the invention. The lamella separator 70 is a gravitational settler containing a plate section 71 including a series of inclined parallel plates 72 stacked closely together to provide an extended settling area and a hopper portion 73 for the accumulation of sludge therein as to be later described. The plates 72 provide a larger settling area per unit volume and improved hydrodynamics as compared to conventional separators therefore resulting in the lamella separator having a much higher capacity that such conventional separators.

A feed stream 74 (such as the mixed stream "30" of FIG. 1) is passed into the lamella separator 70 through inlets 75 at the bottom portion 76 of the plate section 71. As the feed liquid flows upward along the plates, solids, e.g., agglomerates, settle out, collect and slide downward along the plates 72 to form a sludge stream 77, which sludge collects in the hopper portion 73 of the separator 70. Clarified liquid overflows at the top portion 78 of the plate section 71 through the overflow outlets 79 and is collected in a line 80. Solids fall off the bottom of the plates and are further thickened in the hopper section 73 of the separator 70. Sludge (underflow) exits the hopper section 73 through ports 81 as a stream 82.

Returning to FIG. 1, the underflow from the separator 32 is removed by way of a stream 36 and may, if desired, be further processed such as shown in phantom in the figure.

As shown, the underflow is passed by means of a pump 40 through the line 36 to a separator device 42, such as a decanter centrifuge, wherein substantial portions of solvent, either or both specific and non-specific solvent, contained in the underflow may be recovered with fines being discarded therefrom. For example, as shown, fines are passed through a stream 44 from the separator device 42 and may, for example, be in the form of a cake solid.

The specific solvent recovered from the underflow is passed by means of a pump 46 through a line 50 as shown and may be contacted with the tar sands extract prior to the passage thereof through the static in-line mixer 26 or other mixing means so as to reduce the amount of fresh specific solvent required in the process.

While the process of the subject invention can technically be used on alternative feed streams, such as various petroleum fractions, for example, it is not generally believed to be presently commercially practical for such applications. Changes in economic circumstances, however, may alter the feasibility of the application of the approach of the invention to such feeds.

Further, while the process of the invention may be applied to tar sands extracts formed by various methods or techniques, it is believed to have particular utility in conjunction with tar sands extracts formed by extraction techniques such as water/solvent extraction or solvent extraction, such as described in U.S. Pat. No. 4,596,651, "Two-Stage Tar Sands Extraction Process," Wolff et al., issued June 24, 1986 and U.S. Pat. No. 4,722,782, "Method For Solvent Treating of Tar Sands With Water Displacement," Graham et al., issued Feb. 2, 1988, both assigned to Standard Oil Company (Indiana) and the disclosures of which are incorporated herein by reference, wherein the extract is formed by slurrying the tar sands with a solvent, more particularly, a non-specific solvent.

The process has particular applicability and utility to the processing of tar sands extracts which comprise bitumen including the heavy component (asphaltenes) thereof (which bitumen is being sought to be recovered), mineral/inorganic fines (the material which is sought to be removed), non-specific solvent (which is utilized in recovering the bitumen from the mineral matter) and, optionally, water, such as in an amount of about 1 to 2 weight percent of the tar sands extract (as may result from the treatment of various water wet sands or the utilization of various solubility reducing additives).

Suitable non-specific solvents useful in the practice of the invention will generally be those organic compounds which are substantially insoluble in water and which dissolve substantially all the bitumen, including the asphaltene component thereof. Such solvents can be unsubstituted or substituted by at least one halogen, oxygen, nitrogen or sulfur atom and have from 1 to 15 carbon atoms. Useful solvents include paraffinic hydrocarbons such as n-butane; methyl and dimethyl butane; n-pentane; n-hexane; n-heptane; n-octane; and methyl, ethyl, dimethyl, and trimethyl pentanes, hexanes, heptanes and octanes; cyclic hydrocarbons such as cyclohexane; aromatic petroleum fractions or aromatic hydrocarbons such as benzene, toluene and the xylenes; methyl ethers; ethyl ethers; methyl ethyl ether; and halogenated derivatives of any of these; and mixtures of any of the aforementioned. Alternatively, if desired, a non-hydrocarbon solvent such as carbon tetrachloride, for example, may be used.

The selection of a proper non-specific solvent will be dependent upon the objectives which are sought to be achieved. In general, solvent materials with low boiling points are, from the perspective of ease of recovery, preferred as they generally result in sharp, well-defined separation from the bitumen. Low boiling point materials, however, generally suffer from high amounts of leakage in mechanical apparatuses and from high flammability which may serve to limit or prevent the use thereof in certain mechanical apparatuses, e.g., mills of grinders. In contrast, solvent materials having high boiling points generally are of low flammability and therefore the use thereof in mechanical apparatuses such as mills or grinders is comparatively safe. However, the high boiling point of these materials generally necessitates operation at higher temperatures and/or lower pressures so as to facilitate solvent recovery. Consequently, a solvent material effective in dissolving the bitumen and having a relatively low boiling point and being relatively easily sealable within mechanical apparatuses such as mills or grinders, so as to facilitate solvent recovery and use, respectively, would be preferred.

As discussed above, bitumen can generally be considered as a three-component system of oils, resins, and asphaltenes, with oils being the lightest component and asphaltenes being the heaviest component. For increased hydrocarbon recovery it will be generally preferred to recover hydrocarbon from all three components of the bitumen, including the asphaltenes. Some solvents, such as the normally specific solvents such as pentane, n-heptane and other relatively low molecular weight straight chain hydrocarbons, can, under particular circumstances as will be described below, function as a non-specific solvent. These solvents are effective in solubilizing bitumen, including the asphaltene component thereof, once the lighter components of the bitumen, e.g., the oil and resin components have been sufficiently solubilized. It is believed that the presence of the oil and resin components in the solvent solution change the solubility parameter of the solution to more closely match that of the asphaltenes. Thus, once the level of bitumen in solution has reached the needed bitumen solubilization threshold, e.g., generally at least about 15 weight percent bitumen in solution, and preferably about 20–30 weight percent bitumen in solution for n-heptane or generally for solvents of similar viscosity and specific gravity, then such solvents also serve to solubilize at least a portion of the asphaltene component of the bitumen. Thus, solvent selection can impact on downstream processing and vice-versa.

As described above, the selection of a particular non-specific solvent for use will likely be dependent on the downstream processing to which the solvent will be subjected to and, because of generally lower overall cost, will preferably be a by-product of the process. Thus, in the commercial practice of the invention, a naphtha cut from a bitumen upgrading step will likely be a preferred solvent, with naphtha range solvents that have been hydrotreated being particularly preferred as they are generally more stable.

In general, the amount of solvent used, while dependent on a number of factors including the type of solvent and tar sands being treated, the particle size of the tar sands, the temperature of the mixture, etc., need only be sufficient to separate the bitumen from the tar sands mineral and thereby form an organic phase separable from the mineral component of the tar sands. Generally, the amount of solvent will range from about 2 to 5 parts of solvent per part of bitumen in the tar sands, particularly for paraffinic and naphtha-like solvents. Lesser or greater amounts of solvent can be used with a corresponding diminishment of the effectiveness, economy of operation, or both for the process. For example, since in most commercial processes the solvent will be recycled, the use of solvent in amounts in excess of that required will increase the costs associated with solvent recovery and recycle. Also, the amount of solvent can be at least in part related to the amount of aqueous medium added and the effectiveness of the solvent utilized, e.g., different solvents more easily solubilize different components of the bitumen. For example, as described above, it has been found that solvents such as n-heptane, which generally solubilize at least a portion of the asphaltene component of bitumen only after at least partial solubilization of the lighter components of the bitumen, are usually required to be present in at least an amount effective to solubilize the oil and resin components of the bitumen sufficiently so that the asphaltene component also at least partially solubilizes therewith. Thus, such solvents must generally be present in a range of about 2–5 parts of solvent per part of bitumen, and preferably about 3–4 parts per part of bitumen, as the presence of too much or too little of such solvents results in not all of the bitumen dissolving. In contrast, solvents such as aromatic and high molecular weight straight hydrocarbon chain solvents are relatively effective in solubilizing all components of the bitumen and can be used in a broader range of concentration.

The selection of a particular specific solvent and the amount of addition of such specific solvent may, at least in part, be based on the particular non-specific solvent used as agglomerates containing asphaltenes and a substantial portion of the fines contained in the tar sands extract are desirably sought to be formed. The selection of particular non-specific and specific solvents is disclosed in previously identified U.S. Pat. No. 4,596,651 and herein incorporated by reference.

Generally, when using a material such as pentane as a specific solvent, a fines settling rate of greater than 0.5 centimeters/minute is preferred, with fines settling rates of about 0.5 centimeters/minute to about 3 centimeters/minute being especially preferred.

In the practice of the invention, generally the quantity of mineral fines selected for agglomeration comprises at least about 80 percent of the fines present in the extract, e.g., the fines rejection rate is at least about 80 percent, i.e., at least about 80 weight percent of the fines contained in the extract upon the contacting of the extract with the specific solvent are separated from the balance of the extract.

In view of the economic trade-off between the loss of unrecovered bitumen and the increased cost associated with the recovery of bitumen therefrom, typically a balance is struck as to what constitutes an acceptable bitumen loss. In general, recovery of at least about 90 percent of the bitumen in the feed is commercialy necessary, while recoveries of at least about 95 percent of the bitumen in the feed are a practical commercial objective with recovery of at least about 98 percent of the bitumen in the feed being a preferred design objective.

It is to be understood that while the invention has been described above with reference to the utilization of a lamella separator to effect separation of agglomerates from the balance of the extract prior to any substantial attrition of the agglomerates, other separation techniques, including other means of gravitatonal separation, centrifugation and filtration, can be used in the practice of the invention and are contemplated herein.

It is also to be understood that while the invention has been described above in reference to application with removal of fines from tar sands extracts, the process is also technically applicable to use on other syncrude or petroleum fractions. Application to such other syncrude or petroleum fractions, however, may not be currently economically feasible.

Further, while the invention is believed to be applicable to all tar sands it is believed to be especially effective for tar sands extracts having a high percentage of heavy component, e.g., asphaltenes, in the bitumen.

In general, in order to avoid or substantially preclude substantial agglomerate attrition, it is important to: (a) minimize distance between the initial contacting of the tar sands extract with the specific solvent and the separation step whereby a substantial portion of the agglomerates are separated from the balance of the extract; (b) minimize the shear rate the mixed stream of the tar sands extract and specific solvent is subjected to; and (c) operate at a material flow rate through the mixer and to and through the separator sufficiently high so as to permit and facilitate the intimate mixing of the specific solvent with the tar sands extract to form agglomerates of asphaltenes and a substantial portion of the fines contained in the extract, but no so high as to result in the substantial attrition of the agglomerates so formed and subsequently their separation from the balance of the extract. Thus, in a particularly preferred embodiment, the static in-line mixer used to effect intimate mixing and the lamella separator used to effect separation of a substantial portion of the agglomerates formed upon mixing are in adjacent relationship, e.g., the mixer and separator are separated by a distance of no more than about 5 feet and preferably no more than about 1–2 feet. Further, the mixing shear rate during the intimate mixing of the specific solvent with the tar sands extract should preferably be maintained in a range of no more than about 7 $sec^{-1}$ to about 20 $sec^{-1}$. In addition, for example, the material flow rate to a lamella separator having a 4 gallon capacity is preferably maintained at a level of no more than about 1250 ml/min. and more preferably is maintained at a level in the range of about 250 ml/min. to about 1000 ml/min, it being understood that the material flow rate is preferably maintained at a fairly constant level as relatively sudden or dramatic changes in the flow rate are not conducive to the prevention or avoidance of agglomerate attrition.

The lamella separator has lamella separator parameters such as the number of plates, plate surface area, settling area per unit volume, plate angle, etc. at lamella separator operating conditions such as to result in the desired separation and thickening action. Specific values for these various lamella separator parameters to effect a desired or selected separation, are determinable by one skilled in the art and guided by the teachings herein.

EXAMPLES

The following examples illustrate the practice of the present invention. It is to be understood that all changes and modifications that come within the spirit of the invention are desired to be protected and thus the invention is not to be construed as limited by these examples.

Two sets of experimental runs were made utilizing a bench scale lamella separator (4 gallon capacity): Set A in which the specific solvent was added directly to the tar sands extract in the feed tank (such as item 12 in FIG. 1) and Set B wherein the specific solvent was added to the tar sands extract separately, just prior to subjecting the extract and specific solvent to intimate mixing followed by separation (i.e., as shown in FIG. 1, the specific solvent is transferred from a storage tank 20 through a line 22 and combined with the tar sands extract of the line 16 to form a stream 24 which is passed through a static, in-line mixer 26 to form a mixed stream 30 which is passed to the separator 32).

In both cases, the tar sands extract was formed utilizing n-heptane as the non-specific solvent and n-pentane as the specific solvent. Thus, the in-flow to the lamella separator for each case is given below in TABLE I, on a weight percent basis.

TABLE I

| IN-FLOW TO LAMELLA SEPARATOR | WT. % |
|---|---|
| Bitumen | 14.1 |
| Water | 3.4 |

TABLE I-continued

| IN-FLOW TO LAMELLA SEPARATOR | WT. % |
|---|---|
| Mineral | 3.8 |
| Solvent (Pentane + Heptane) | 78.7 |
| Ash in Bitumen (Solvent Free Basis) | 21.0 |

The results of typical runs for each of sets A and B are given below in TABLE II.

TABLE II

| | SET | |
|---|---|---|
| | A | B |
| Mineral Settling Rate (cm/min.) | 0.3 | 1.0 |
| Feed Rate (Extract + Specific Solvent) (ml/min.) | 140 | 600 |
| wt. % Ash in Bitumen in Separator Overflow | 1.9 | 1.2 |
| wt. % Feed in Separator Underflow | 45 | 16 |
| wt. % Bitumen in Feed in Separator Underflow | 47 | 19 |

Discussion of Examples

The above, side-by-side comparison of Set A, wherein the specific solvent was added directly to the tar samds extract feed tank, and Set B, wherein the specific solvent was added separately to the tar sands extract just prior to the subjection of the tar sands extract and specific solvent to the intimate mixing of the in-line mixer, followed by separation of agglomerates from the balance of the extract by the lamella separator, illustrates that Set B resulted in increased mineral settling areas and reduced agglomerate attrition (e.g., reduced wt.% ash in bitumen in the separator overflow). Further, the higher mineral settling rates obtained with Set B can be applied to alter lamella separator parameters such as the number of plates, plate surface area, settling area per unit volume, plate angle, etc., such as to reduce the number or the size of lamella plates needed to remove a given amount of fines from an extract. In addition, the relative amount of underflow resulting from Set B is reduced, thus reducing the amount of material requiring further processing for the recovery thereof.

The foregoing detailed description is given for clearness of understanding only, and no unnecessary limitations are to be understood therefrom, as modifications within the scope of the invention will be obvious to those skilled in the art.

What is claimed:

1. A method of removing fines from a tar sands extract comprising bitumen, non-specific solvent and mineral fines, said method comprising the steps of:

contacting a tar sands extract comprising non-specific solvent, fines and bitumen including asphaltenes, with a specific solvent effective to agglomerate a selected quantity of mineral fines contained in said extract;

intimately mixing said specific solvent with said extract to form agglomerates comprising asphaltenes and a substantial portion of said fines contained in said extract; and separating a substantial portion of said agglomerates from the balance of said extract prior to any substantial attrition of said agglomerates.

2. The method of claim 1 wherein said intimate mixing comprises static in-line mixing.

3. The method of claim 1 wherein said separating step comprises a separation technique selected from the group consisting of gravitational separation, centrifugation, and filtration.

4. The method of claim 3 wherein said separation technique comprises gravitational separation by means of a lamella separator.

5. The method of claim 1 wherein substantial attrition comprises attrition of more than about 10 percent of the total number of agglomerates formed prior to said separation step and said extract contacted with said specific solvent is subjected to a mixing shear rate maintained in a range of no more than about 7 $sec^{-1}$ to about 20 $sec^{-1}$.

6. The method of claim 1 wherein said specific solvent is selected from the group consisting of $C_3$–$C_7$ alkanes and petroleum fractions having boiling point ranges corresponding to those of $C_3$–$C_7$ alkanes.

7. The method of claim 1 wherein the non-specific solvent comprises a solvent selected from the group consisting of cyclic hydrocarbons, aromatic petroleum fractions and naphtha cut solvents.

8. The method of claim 1 wherein said tar sands extract is formed by slurrying tar sands with a specific solvent.

9. The method of claim 1 wherein said fines comprise inorganic material selected from the group consisting of clays, carbonates, silicates and mixtures thereof, have a size less than about 10 microns and are present in an amount of about 5 weight percent to about 50 weight percent of said extract based on solvent free bitumen.

10. The method of claim 1 wherein said agglomerates separated from the balance of said extract comprise at least about 80 weight percent of said fines contained in said extract upon said contacting step.

11. A method of removing fines from a tar sands extract comprising non-specific solvent, fines and bitumen, said method comprising the steps of:

static in-line mixing a specific solvent with a tar sands extract comprising non-specific solvent, bitumen including asphaltenes and fines comprising inorganic materials selected from the group consisting of clays, carbonates, silicates and mixtures thereof, with said fines having a size less than about 10 microns and being present in an amount of about 5 weight percent to about 50 weight percent of said extract based on solvent free bitumen, to form agglomerates comprising asphaltenes and a substantial portion of the fines of said extract; and gravitationally separating a substantial portion of said agglomerates from the balance of said extract to avoid substantial attrition of said agglomerates.

12. The method of claim 11 wherein said gravitational separation is by means of a lamella separator.

13. The method of claim 12 wherein substantial attrition comprises attrition of more than about 10 percent of the total number of agglomerates formed as a result of said mixing step and said extract mixed with said specific solvent is subjected to a mixing shear rate maintained in a range of no more than about 7 $sec^{-1}$ to about 20 $sec^{-1}$.

14. The method of claim 11 wherein said specific solvent is selected from the group consisting of $C_3$–$C_7$ alkanes and petroleum fractions having boiling point ranges corresponding to those of $C_3$–$C_7$ alkanes and said non-specific solvent comprises a solvent selected from the group consisting of cyclic hydrocarbons, aromatic petroleum fractions and naphtha cut solvents.

15. The method of claim 11 wherein said agglomerates separated from the balance of said extract comprise at least about 80 weight percent of said fines contained in said extract.

16. A method of removing fines from tar sands, said method comprising the steps of:

slurrying tar sands including asphaltenes and fines comprising inorganic materials selected from the group consisting of clays, carbonates, silicates and mixtures thereof, with said fines having a size less than about 10 microns, with a non-specific solvent selected from the group consisting of cyclic hydrocarbons, aromatic petroleum fractions and naphtha cut solvents to form a tar sands extract, with said fines being present in an amount of about 5 weight percent to about 50 weight percent of said extract based on solvent free bitumen;

adding specific solvent selected from the group consisting of $C_3$14 $C_7$ alkanes and petroleum fractions having boiling point ranges corresponding to those of $C_3$–$C_7$ alkanes to said tar sands extract effective to agglomerate a selected quantity of fines contained in said extract;

mixing said specific solvent with said tar sands extract in a static in-line mixer; and gravitationally separating a substantial portion of said agglomerates from the balance of said extract in a lamella separator to avoid attrition of more than about 10 percent of the total number of agglomerates formed as a result of said mixing and to attain a fines rejection rate of at least about 80 percent.

* * * * *

UNITED STATES PATENT AND TRADEMARK OFFICE

CERTIFICATE OF CORRECTION

PATENT NO. : 4,906,355

DATED : March 6, 1990

INVENTOR(S) : William J. Lechnick, Richard A. Stone

It is certified that error appears in the above-identified patent and that said Letters Patent is hereby corrected as shown below:

| Col. | Line | |
|---|---|---|
| 2 | 18 | "Solvent" should be --Solvents-- |
| 4 | 25 | "that" should be --than-- |
| 5 | 55 | "of" should be --or-- |
| 9 | 36 | "areas" should be --rates-- |
| 10 | 29 | "material" should be --materials-- |
| 12 | 4 | "$C_3$14 $C_7$" should be --$C_3$-$C_7$-- |

Signed and Sealed this

Second Day of July, 1991

*Attest:*

*Attesting Officer*

HARRY F. MANBECK, JR.

*Commissioner of Patents and Trademarks*